US005160768A

United States Patent [19]

Antoon, Jr.

[11] Patent Number: 5,160,768

[45] Date of Patent: Nov. 3, 1992

[54] CURABLE SILICONE-COATED MICROPOROUS FILMS FOR CONTROLLED ATMOSPHERE PACKAGING

[75] Inventor: Mitchell K. Antoon, Jr., Wilmington, Del.

[73] Assignee: Hercules Incorporated, Wilmington, Del.

[21] Appl. No.: 262,764

[22] Filed: Oct. 25, 1988

[51] Int. Cl.[5] ..... B65B 25/04; B65D 85/34

[52] U.S. Cl. ..... 428/35.2; 428/36.6; 428/447; 428/910; 426/106; 426/418; 426/419

[58] Field of Search ..... 426/418, 419, 106; 428/35.2, 36.6, 447, 910

[56] References Cited

U.S. PATENT DOCUMENTS

| | | | |
|---|---|---|---|
| 3,450,542 | 6/1969 | Badran | 426/419 |
| 3,507,667 | 4/1970 | Magnen | 426/419 |
| 4,224,347 | 9/1980 | Woodruff | 426/419 |
| 4,472,328 | 9/1984 | Sugimoto et al. | 264/41 |
| 4,515,266 | 5/1985 | Myers | 426/419 |
| 4,777,073 | 10/1988 | Steth | 428/155 |

FOREIGN PATENT DOCUMENTS

| | | | |
|---|---|---|---|
| 0829484 | 5/1981 | U.S.S.R. | 426/419 |

*Primary Examiner*—Ellis P. Robinson

*Attorney, Agent, or Firm*—David Edwards; John E. Crowe

[57] ABSTRACT

A container providing controlled atmospheric storage of produce (i.e., fresh fruits, vegetables and flowers) to improve retention of product freshness by adjusting the carbon dioxide to oxygen ratio, for the storage of said produce, can be attained and maintained, thereby retarding premature maturation and spoilage. The environment is controlled by providing a microporous membrane panel of a uniaxially or biaxially oriented microporous polyolefin coated with a cured silicone elastomer, said panel being of limited carbon dioxide and oxygen permeance on an otherwise substantially impermeable container. The size of the area of the panel is a function of its permeance, the amount and respiration rate of the contents, and the ratio of carbon dioxide to oxygen desired.

5 Claims, No Drawings

CURABLE SILICONE-COATED MICROPOROUS FILMS FOR CONTROLLED ATMOSPHERE PACKAGING

BACKGROUND OF THE INVENTION

This invention relates to the controlled atmospheric storage of fresh fruits and vegetables, and specifically to a container (package) that controls the atmosphere surrounding the packaged fruit or vegetable product by the container having a window in at least one of its walls with a panel therein of a microporous film coated with a thin layer of a cured silicone elastomrer to improve retention of product freshness.

Maintaining the flavor, texture and eating qualities of fresh fruits and vegetables, and extending the shelf life of flowers (hereinafter "produce" collectively) from the time of harvest through the time of consumption is an obvious problem. In addition, there is a large unsatisfied need for preprepared foods, such as cut-up lettuce, carrots, and whole salads that have acceptable shelf life. The most commonly used technique has been refrigeration. Some items, such as tomatoes, bananas and citrus fruits, are routinely picked in a less-than-ripe condition and stored at reduced temperatures until they are sold. Other products, such as grapes and lettuce, are picked at maturity and refrigerated. The reduced temperature helps to retard further ripening, but only for relatively short time periods and may be detrimental to the keeping quality of the product after it is exposed to room temperature.

Other popular techniques used for extending the shelf-life of produce, meats, and poultry, are vacuum packaging and modified atmosphere packaging ("MAP"). MAP involves the injection of an artificial atmosphere into a package and has been used with some success to increase the shelf life of some of these items. Under the MAP system, the stored item receives an ideal atmosphere initially, but the respiration process of the item continuously changes that atmosphere away from the initial state, thus reducing the shelf life.

For each produce type there is an optimum range of concentrations of $CO_2$ and $O_2$ at which its respiration is retarded and quality is improved to the greatest extent. For instance, some produce benefit from relatively high levels of $CO_2$, e.g., strawberries and mushrooms, while others such as lettuce and tomatoes store better at lower levels of $CO_2$.

Likewise, each produce type also has its own individual respiration rate which can be expressed as cubic centimeters of oxygen per kg/hour.

It is known that the maturation rate of produce can be reduced by controlling the atmosphere surrounding the produce so that an optimum $O_2$ range and relative concentrations of $CO_2$ to $O_2$ are maintained. For instance, Russian Patent 719,555 discloses storage of produce for 6 to 9 months in a temperature range between 0° and 20° C. in a polypropylene bag provided with a ventilation aperture containing a semipermeable membrane that maintains the desired composition of atmosphere inside; the membrane is a plastic material with perforations coated with polyvinyltrimethylsilane with selective gas permeability. French Patent 2,531,042 discloses a container to prevent food dehydration inside a refrigerator where the container has a window with a membrane therein for selectively permitting air to enter while carbon dioxide and ethylene gas escape from the container; the membrane is a sheet of polyamide coated with a layer of polydimethylsiloxane or is a sheet of polyethylene. U.S. Pat. No. 3,507,667 discloses a storage bag of a plastic film (negligible permeability) provided with a window containing therein a panel of poly(organosiloxane) elastomer on a square-mesh fabric having 40 filaments per centimeter of poly (ethylene terephthalate). Japanese Publication No. 61157325 discloses a membrane suitable to produce $O_2$-enriched air used for combustion or medical treatment; the membrane is obtained by loading organosiloxane into pores of porous thin films of polyolefins. The published paper "Controlling Atmosphere in a Fresh-Fruit Package" by P. Veeraju and M. Karel, Modern Packaging, Vol. 40, #2 (1966) pages 169–172, 254, discloses using variable-sized panels of polyethylene or permeable parchment paper in the walls of an otherwise impermeable package to establish a controlled atmosphere, and shows experimentally-derived calculations to determine the panel sizes that are appropriate for different respiration rates of produce. However, problems were encountered with the use of film, requiring excessive areas of permeable panels (over 258 $cm^2$ (40 $in^2$)), or the use of paper, which is undesirably wettable.

As indicate, the most advanced known controlled atmosphere storage techniques are not entirely satisfactory. There is a need for containers for packaging produce in which the atmosphere can be predictably controlled at approximately the point required to retard the ripening process and retain product freshness, while permitting the use of panels having an area of the order of 25.8 $cm^2$ (4 $in^2$) or less, which can easily be so situated that they are not likely to be blocked by other containers in stacking or handling. The area and permeance required are independently and directly dependent on the weight of produce enclosed.

SUMMARY OF THE INVENTION

This invention is directed to a container capable of creating within it a preselected carbon dioxide and oxygen concentration in the presence of respiring fresh fruit, vegetables or flowers, that is constructed of a substantially gas-impermeable, material having a gas-permeable panel in one or more of its walls to provide a controlled flow or flux of $CO_2$ and $O_2$ through its walls, where the panel is a microporous plastic membrane that is a laminate of a uniaxially or biaxially oriented film comprised of a polyolefin, filled with 40 to 75% of calcium carbonate, based on the total weight of the film, coated with a cured silicone elastomer, which membrane has an oxygen permeance between about 77,500 and 15,500,000 cc/$m^2$-day-atmosphere (5,000 and 1,000,000 cc/100 $in^2$-day-atmosphere), and a $CO_2$ to $O_2$ permeance ratio of from about 3 to 6, the permeance and area of the membrane being such as to provide a flux of $O_2$ approximately equal to the predicted $O_2$ respiration rate at steady-state for not more than 3.0 kg of the enclosed fruit, vegetable or flower, and the carbon dioxide permeance of the membrane being such as to maintain the desired optimum ranges of carbon dioxide and oxygen for not more than the said 3.0 kg of enclosed produce.

DETAILED DESCRIPTION OF THE PREFERRED EMBODIMENT

In the following description, the units applied to the terms used in reference to the flow of a particular gas through a film are "flux", expressed as cc/day, and "permeance" expressed as cc/m$^2$-day-atmosphere. The "permeability constant" of a particular film is expressed as cc-mm/m$^2$-day-atmosphere. (The values are converted from U.S. usage, from which mils and 100 in$^2$ are replaced by mm and m$^2$ to give the above units. In the pressure units, one atmosphere is 101,325 Pa; they define the partial pressure differences or permeation "driving forces" on opposite sides of the film involving the $CO_2$ or $O_2$ gases involved).

Permeance is measured with an apparatus that employs gas pressure ranging from 6.895 to 206.9 kPa (1 to 30 psi) as the driving force and a mass flow meter to measure the gas flow or flux through the membrane.

The panel (membrane) in the container of the instant invention is a laminate of a microporous plastic film and a curable silicone elastomer having an oxygen permeance between about 77,500 and 15,500,000 cc/m$^2$-day-atmosphere (5,000 and 1,000,000 cc/100in$^2$-day-atmosphere). Preferably, the gas-permeable panel is a laminate of a microporous propylene polymer film filled with 40 to 75% by weight of $CaCO_3$ and coated with a curable silicone elastomer having an oxygen 5 permeance between about 310,000 and 13,950,000 cc/m$^2$-day-atmosphere (20,000 and 900,000 cc/100 in$^2$-day-atmosphere) for produce weighing in the normal range for retail packaging (less than one kg) (2.2 lb). For normal institutional or food-service packaging with higher unit produce weights, the area and permeance of the panel can be increased as required.

A critical feature for high permeance and high $CO_2$-:$O_2$ ratio in the coated film of this invention is that the substrate film, although often much thicker than the coating, should be at least two times (preferably at least 10 times) as permeable as the coating itself.

The silicone elastomer coating can be applied from a water emulsion or in pure form as a viscous curable polymer. Although other coatings can be used, lightly crosslinked silicone elastomers are preferred because they are among the most permeable of all polymers and some are FDA-approved as well. Examples of silicone elastomers useful in this invention are homopolymers and copolymers of crosslinked poly(dimethylsiloxane).

More preferably, in a container according to the invention, to predictably control the atmosphere surrounding the packaged fruit or vegetable product, the permeance and area of the membrane is such as to provide a flux of $O_2$ approximately equal to the predicted $O_2$ respiration rate at steady state of not more than 3.0 kg (6.6 lb) of enclosed fruit, vegetable or flower, and the carbon dioxide permeance of the membrane being such as to maintain the desired optimum ranges of carbon dioxide and oxygen for not more than the said 3.0 kg (6.6 lb) of enclosed produce.

In a container according to the invention, the microporous membrane is uniaxially or biaxially oriented olefin film such as polypropylene, polyethylene, ethylene-propylene copolymers, polybutene-1, or poly(4-methylpentene-1), the film being filled with 40 to 75% of a filler such as calcium carbonate, based on the total weight of the film. The preferred microporous membrane is a polypropylene film filled with 50 to 65% of $CaCO_3$ that is uniaxially oriented because this uniaxially oriented film has narrow elongated pores on the surface that are more readily bridged by an intact silicone membrane.

The following table records published respiration rates and optimum storage conditions for several popular types of produce:

TABLE 1

| | Respiration Rate* | | Desired Atmosphere (Vol %) | |
|---|---|---|---|---|
| | 4° C. | 21° C. | $O_2$ | $CO_2$ |
| Lettuce, head | 8.5 | 28 | 1-5 | 0 |
| Tomato, mature-green | 3.4 | 18 | 3-5 | 0-3 |
| Banana, ripening | | 44 | 2-5 | 2-5 |
| Avocado | 13 | 107 | 2-5 | 3-10 |
| Peach | 3.9 | 41 | 1-2 | 5 |
| Cherry, sweet | 6.0 | 15 | 3-10 | 10-12 |
| Strawberry | 13 | 76 | 10 | 15-20 |
| Asparagus | 42 | 113 | 21 | 5-14 |
| Mushroom | 36 | 148 | 6-10 | 10-15 |
| Broccoli (main stems + florets) | 50 | 158 | 1-2 | 5-10 |

*Ref: USDA Handbook 66; assume rate @ normal atmosphere. Rate is cc of $O_2$ per kg per hr.

Taking into consideration the respiration characteristics of the produce to be packaged and the optimum $CO_2$ and $O_2$ ranges required to retard its maturation, it is possible to design a container according to the invention for packaging any produce in substantially any quantity.

The ability to control the atmosphere within the container is derived not only from the ability to adjust the area of the permeable silicone-coated plastic membrane that allows communication between the interior and exterior of the container, but also to provide silicone coated plastic membranes that have relatively high permeance values and therefore provide the necessary flexibility to adapt to a variety of produce. Virtually all thin films of synthetic resin are somewhat permeable by oxygen or carbon dioxide, as shown by known atmosphere-limiting packaging systems, and they may have $CO_2/O_2$ permeance ratios of 1/1 and higher. However, an essentially monolithic and continuous sheet of film is not usually sufficiently permeable to allow the flexibility and precise control of the $CO_2/O_2$ ratio in the atmosphere that is required for optimum retardation of the maturation process, at least without using excessively large panel area/product weight ratios that make the package unduly cumbersome. Thus, the silicone coated film must be selected to have a permeability sufficient to allow the type of control required within a reasonable time and an area suitable for the amount of produce being packaged.

Microporous films and the preparation thereof are known in the art. They can be prepared, for example, by casting a sheet of a mixture of the polymer highly loaded with a filler material and drawing the resultant sheet under orienting conditions to effect orientation of the polymer along its longitudinal and transverse axes. At orienting temperatures, the polymer pulls away from the filler material causing voids and pores to form in the film matrix. The degree of permeability that results is a function of the amount of filler in the polymer, the amount of draw imposed upon the polymer and the temperature at which the drawing is carried out.

A large number of inorganic materials have been shown to be effective as fillers for effecting the voiding and pore formation. These include, e.g., various types of clay, barium sulfate, calcium carbonate, silica, diatomaceous earth and titania. Some particulate organic polymers that are higher melting than the matrix polymer, are also useful fillers, such as polyesters, polyamides and polystyrene. Calcium carbonate marketed under the trademark ATOMITE ® is the preferred filler because the average particle size of this material is 3 microns which gives smaller surface pores in the film than larger particle size calcium carbonate such as $CaCO_3$ sold under the trademark DURAMITE ® that has an average particle size of 12 microns.

A particularly useful membrane having the correct porosity characteristics for use in the container of this invention as defined above is a microporous film based on polypropylene comprised of about 40 to 60% of a propylene polymer mixture and 50 to 65% of calcium carbonate, biaxially or uniaxially oriented at a temperature between about 100° and 170° C. that is coated with a thin layer of cured silicone elastomer. The $CO_2/O_2$ permeance ratio of silicone coated microporous film of this invention can range from 3 to 6 with the preferred range being 4 to 5.

The container can be of any appropriate size, e.g., from as small as 100 cc up to several liters or more. The material of construction of the container is not critical so long as the entire container is impermeable to moisture and substantially impermeable to air except in the control panel area. By "substantially impermeable" is meant a permeability so low that, if the container is sealed with produce inside (without any permeable membrane), the oxygen in the container will be completely exhausted or the oxygen level will equilibrate at such a low level that anaerobic deterioration can occur. Thus glass, metal or plastic can be employed. Plastic materials such as heavy gauge polyolefins, poly(vinyl chloride), or polystyrene are preferred. The plastic materials should be substantially impermeable due to their thickness, but any minor degree of permeability may be taken into account when sizing the panel.

The atmospheric composition within the container is controlled by the size of the permeable control panel relative to the mass of produce, the volume of free gas space within the filled container, the respiration rate of the produce, and the panel's permeability characteristics, i.e., flux rate and $CO_2/O_2$ ratio. If the proper relationship between these variables is achieved, a steady state at the desired relative concentration of $CO_2$ and $O_2$ ratio can be reached within about a day or less.

The following examples were carried out using a prototype CAP device comprised of a glass vessel having a hermetically sealable lid with an opening of a preselected size therein. This opening was covered with a panel of the material to be tested with the area of the panel being tested from about 1 to 4 in.$^2$. The device was also fitted with a tap for taking samples of the atmosphere within the device.

EXAMPLES 1 TO 10

Standard Procedure

The coating of the film was carried out as follows:

Pieces of the uniaxially or biaxially oriented film approximately six inches square were clamped down onto a glass plate and a few grams of the silicone elastomer were placed on the film at one end; the silicone elastomer was then spread across the film with a #8 Meyer rod at room temperature. This composition (laminate) was permitted to stand overnight so that the coating could crosslink (cure) at room temperature.

Different silicone elastomer coated polyolefin compositions were tested and the results were reported in Table 2, infra; Table 3 describes the compositions of the porous substrates and the composition of the silicone coatings. Table 3 also identifies two uncoated uniaxially-oriented microporous films (H and I), and a substantially impermeable "control" panel (J).

TABLE 2

SILICONE-COATED FILM PROPERTIES AND EFFECTS ON BROCCOLI SHELF-LIFE

All produce data is for broccoli stored in sealed glass vessels at 4° C. Vessels have a window for a CAP membrane. Steady-state gas levels and shelf life measurements were done after 15 days storage at 4° C.

| Examples | Film Composition | PDF[1] Permeances cc/100 in$^2$-atm-day (thousands) $O_2$ | $CO_2$ | $CO_2/O_2$ Ratio | Treated Area of Film (in$^2$) | Broccoli Weight grams | $O_2$ Steady-state, % | $CO_2$ Steady-state, % | Appearance[2] (rating) | Odor[3] (rating) | Chlorophyl Content, mg/gfw | Weight Loss, % |
|---|---|---|---|---|---|---|---|---|---|---|---|---|
| 1 | A | 19.0 | 67.3 | 3.5 | 4 | 205.7 | 8 | 2 | GOOD (2) | GOOD (2) | 0.255 | 4.5 |
| 2 | B | 25.2 | 86.2 | 3.4 | 2 | 200.1 | 9 | 2 | GOOD (3) | GOOD (4) | 0.388 | |
| 3 | C | 9.2 | 32.5 | 3.5 | 4 | 100.6 | 11 | 2 | GOOD (2) | GOOD (2) | | 5.4 |
| 4 | D | 226.8 | 785.1 | 3.5 | 1 | 503.5 | 5 | 3 | GOOD (4) | FAIR (5) | | 2.5 |
| 5 | E | 5.9 | 24.3 | 4.1 | — | | | | | | | |
| 6 | F | 54.1 | 161.5 | 3.0 | — | | | | | | | |
| | G | 30 | 150 | 5 | 2 | 201.3 | 7 | 3 | FAIR (5) | FAIR (5) | 0.308 | |
| 8 | H | 683.3 | | 1 | 2 | 188.2 | 17 | 3 | POOR (6) | FAIR (4.5) | 0.248 | |
| 9 | I | 184.6 | 208.2 | 1 | 1 | 299.35 | 6 | 15.5 | | POOR (6) | | 2.9 |
| 10 | J | 0 | 0 | | — | 207.0 | 1 | 30 | GOOD (4) | POOR (8) | 0.198 | |

[1]PDF = Pressure Driving Force method for film permeance.

[2]Appearance is based on two factors: High Level of greenness and low level of brown spots.

[3]Appearance and Odor are determined by sensory evaluation using a scale of 1 (best; ideal) to 9 (worst). A rating of 5 is considered "fair" and marginally acceptable; ratings of 6–9 are considered unacceptable.

TABLE 3

| Film | Polymer % | Calcium Stearate % | $CaCO_3$ Atomite (%) | B-225 Stabilizer % | Silicone Elastomer | Orientation | Gurley No. (sec) | PDF Permeances cc/100 in$^2$ atm-day | Process Description |
|---|---|---|---|---|---|---|---|---|---|
| A | Polypropylene[1] 19.93 & 19.93 | 0.16 | 59.78 | 0.20 | Dow Corning 734 0.3034 g on 3.5" dia. circle | Biaxial FD 5.3X @ 144-156° C. TD 6X @ 156-166° C. | 150 | | Standard Procedure |
| B | Polypropylene[1] 24.82 & 24.82 | 0.50 | 49.64 | 0.22 | Dow Corning 734 0.2594 g on 3.5" dia. circle | Biaxial at 120° C. TD 3.5x at 150° C. | 89 | | Standard Procedure |
| C | Polypropylene[1] 24.82 & 24.82 | 0.50 | 49.64 | 0.22 | Dow Corning 734 0.2542 g on 3.5" dia. circle | Uniaxial at 120° C. | | $O_2$ = 1,430,000 | Standard Procedure |
| D | Accurel[a] 2E HF | | | | Dow Corning 734 0.02 g on 3.5" dia. circle | | 1.5 | | Standard Procedure a- a commercial micropourous polypropylene film marketed by Enka Company |
| E | Polypropylene[1] 24.82 & 24.82 | 0.50 | 49.64 | 0.22 | Emulsion[b] 0.255 g on 3.5" dia. circle | Biaxial FD 5x at 120° C. TD 4x at 161° C. | 119 | | Standard Procedure plus applied a second coat of elastomer after the first coat dried. b- see footnote below |
| F | Polypropylene[1] 24.82 & 24.82 | 0.50 | 49.64 | 0.22 | Emulsion[b] less than 0.1 g on 3.5" dia. circle | Biaxial FD 5x at 120° C. TD 4x at 161° C. | 119 | | Same as E |
| G | True Membrane[c] | | | | | | | $O_2$ = 30,000 $CO_2$ = 150,000 | Standard Procedure c- a commercial silicone-coated fabric marketed by SciMed Life Systems, Inc. |
| H | Polypropylene[1] 25.81 & 25.81 | 0.52 | 47.64 | 0.23 | | Uniaxial FD 5.5x at 105° C. | | $O_2$ = 683,000 | Standard Procedure |
| I | Polypropylene[1] 24.82 & 24.82 | 0.50 | 49.64 | 0.22 | | Biaxial FD 5.2 x @ 111° C., TD 6x @ 163-170° C. | | $O_2$ = 184,600 $CO_2$ = 208,200 | Standard Procedure |
| J | Impermeable Plastic[d] | | | | | | | less than 100 | d- a ¼ inch thick piece of poly(methylmethacrylate) |

[b]The emulsion composition is (1) 80 parts of a mixture of 15 parts of a curable silicone emulsion (marketed by General Electric Co. under trademark SM 2013) to 1 part of a catalyst (marketed by GE under SM 2014), (2) 20 parts of a 10% poly-(vinyl alcohol) in distilled water marketed by Air Products Co. a Vinol ® 540, (3) 1 part of a surfactant marketed as Igepal ® CA630 by GAF Corp., and (4) 1 part distilled water.
[1]The polymer is a mixture of Pro-fax 6501 and Pro-fax SA 841.

The examples demonstrate that the shelf life and quality of broccoli in sealed containers are best when a properly-selected silicone-coated microporous film panel regulates the inflow/outflow of gases. In particular, whenever the $O_2$ level in a package is less than the ambient level of 21%, a much lower $CO_2$ level is established when a silicone-coated microporous film is used as compared to alternative materials.

Examples 1 to 4 show that appearance, greenness, and odor are best when RTV silicone-coated microporous films control the atmosphere. Since the $CO_2/O_2$ ratio of these controlled atmosphere packaging (CAP) membranes is 3 to 4, a low $CO_2$ level is established, even when the $O_2$ level is low. As a result, the organoleptic ratings are "fair" or "good" in every case.

Examples 5 to 6 show that the silicone coating can be applied from a water-based emulsion to produce a membrane having $CO_2/O_2$ ratio greater than 1. Example 7 shows that a silicone-coated nonwoven fabric works better than an impermeable panel (Example 10) or membranes having $CO_2/O_2$ ratio=1 (Examples 8 to 9) but not as well as the silicone-coated microporous films (Examples 1 to 4).

Examples 8 to 9 show that, regardless of the steady-state oxygen level, microporous membranes having $CO_2:O_2=1$ perform worse than the silicone-coated membranes in Examples 1 to 4. The membrane of Example 8 was chosen so that a high $O_2$ level was established; the broccoli was rated "poor" on appearance. The membrane of Example 9 was chosen so that a medium $O_2$ level was established; the high $CO_2$ level resulted in a "poor" rating on odor. The impermeable panel of Example 10 was chosen so that a low $O_2$ level was established; again the high $CO_2$ level resulted in a "poor" rating on odor.

What is claimed is:

1. A container capable of creating within it a preselected carbon dioxide and oxygen concentration in the presence of respiring fresh fruit, vegetables or flowers, that is constructed of a substantially gas-impermeable material having a gas-permeable panel in one or more of its walls to provide a controlled flow or flux of $CO_2$ and $O_2$ through its walls, where the panel is a microporous plastic membrane that is a laminate of a uniaxially or biaxially oriented film comprised of a polyolefin, filled with 40 to 75 % of calcium carbonate, based on the total weight of the film, coated with a cured silicone elastomer, which membrane has an oxygen permeance between about 77,500 and 15,500,000 cc/m$^2$-day-atmosphere and a $CO_2$ to $O_2$ permeance ratio of from about 3 to 6, the permeance and area of the membrane being such as to provide a flux of $O_2$ approximately equal to the predicted $O_2$ respiration rate at steady-state for not more than 3.0 kg of the enclosed fruit, vegetable or flower, and the carbon dioxide permeance of the membrane being such as to maintain the desired optimum ranges of carbon dioxide and oxygen for not more than the said 3.0 kg of enclosed produce.

2. The container of claim 1, wherein the microporous membrane has an oxygen permeance between about 310,000 and 13,950,000 cc/m$^2$-day-atmosphere.

3. The container of claim 2, wherein the microporous membrane has a carbon dioxide to oxygen permeance ratio in the range of from about 4 to 5.

4. The container of claim 3, wherein the polyolefin is selected from polypropylene, polyethylene, ethylene-propylene copolymers, polybutene-1, and poly(4-methylpentene-1).

5. The container of claim 4, wherein the silicone elastomer is selected from homopolymers and copolymers of crosslinked poly(dimethylsiloxane).

* * * * *